United States Patent [19]

Delacour et al.

[11] Patent Number: 4,646,525

[45] Date of Patent: Mar. 3, 1987

[54] VESSEL FOR A CRYOGENIC MIXTURE AND A PROCESS FOR DRAWING OFF THE LIQUID

[75] Inventors: Pierre Delacour, Noyaret; Roger Prost, Saint-Egreve; Gérard Mondain-Monval, Paris, all of France

[73] Assignee: L'Air Liquide, Societe Anonyme pour l'Etude et l'Exploitation des Procedes Georges Claude, Paris, France

[21] Appl. No.: 790,806

[22] Filed: Oct. 25, 1985

[51] Int. Cl.[4] ..... F17C 13/00

[52] U.S. Cl. ..... 62/54; 62/514 R

[58] Field of Search ..... 62/54, 55, 514 R

[56] References Cited

U.S. PATENT DOCUMENTS

| | | | |
|---|---|---|---|
| 2,964,918 | 12/1960 | Hansen et al. | 62/55 |
| 3,092,972 | 6/1963 | Poorman et al. | 62/55 |
| 3,225,825 | 12/1965 | Lewis | 62/54 |
| 3,455,117 | 7/1969 | Prelowski | 62/55 |
| 3,696,627 | 10/1972 | Longsworth | 62/514 R |
| 3,696,636 | 10/1972 | Mille | 62/514 R |
| 3,722,581 | 3/1973 | Sauer | 62/514 R |
| 4,510,760 | 4/1985 | Wieland | 62/55 |

FOREIGN PATENT DOCUMENTS

| | | |
|---|---|---|
| 1201524 | 12/1959 | France . |
| 1533684 | 7/1968 | France . |
| 2406782 | 5/1979 | France . |
| 148588 | 7/1920 | United Kingdom . |

*Primary Examiner*—Ronald C. Capossela

*Attorney, Agent, or Firm*—Young & Thompson

[57] ABSTRACT

The liquid is drawn from this vessel through a coiled tube (20) provided with a calibrated valve (21) at its inlet. The resulting drop in pressure is compensated for by means of a pressure raising circuit (27). Application in the storage of liquefied air.

16 Claims, 3 Drawing Figures

VESSEL FOR A CRYOGENIC MIXTURE AND A PROCESS FOR DRAWING OFF THE LIQUID

The present invention relates to a vessel for a liquid cyrogenic mixture of the type comprising a reservoir in which is disposed a conduit which forms a heat exchanger and extends through the neck of the reservoir and whose inlet is connected to the lower part of the reservoir by means of an element creating a pressure drop, a conduit for drawing off the liquid mixture, and a circuit for raising pressure.

In conventional cryogenic vessels, the pressure is maintained substantially constant notwithstanding the inevitable entry of heat by the intermittent elimination of a part of the gaseous phase by means of a calibrated valve. The liquid cryogenic mixtures cannot be kept in such a vessel, since the vaporization of the liquid resulting from the entry of heat is accompanied by a distillation of this liquid so that the latter becomes gradually enriched with the least volatile component(s).

Vessels of the aforementioned type have been proposed in order to avoid such an evolution of the composition of the liquid. Indeed, when the internal pressure of the reservoir exceeds the outlet pressure of the heat exchanger by an amount predetermined by the pressure drop creating element, a certain amount of liquid flows through the latter and, as it is returned to a lower pressure, it is vaporized and then reheated by taking the corresponding heat in the vessel. The entry of heat is thus compensated for without putting the gaseous phase in communication with the atmosphere, at the expense of a slight loss of liquid, and the composition of the liquid remains practically costant throughout the emptying of the vessel. The escape of product is on the same order as that which results from putting the gaseous phase in communication with the atmosphere mentioned hereinbefore.

An important drawback of this solution resides in the increased complexity of the structure of the reservoir, and in particular in the difficulty of adapting it to existing reservoirs having a relatively small capacity and a narrow neck. Indeed, the reservoir must include, in addition to the conduit for drawing off liquid and the cooling circuit comprising the exchanger, at least one filling conduit and, when the reservoir is adapted to be filled with already-prepared liquid mixture, a circuit for the circulation of a refrigerating auxiliary fluid ensuring a supercooling of the liquid mixture and consequently an absence of distillation during the filling.

An object of the invention is to solve this problem while simplifying the structure of the reservoir.

The invention therefore provides a vessel of the aforementioned type wherein the conduit for drawing off the liquid mixture is connected to the outlet of the heat exchanger so that the whole of the liquid drawn off passes through this exchanger.

In an advantageous embodiment, the heat exchanger extends roughly throughout the height of the reservoir.

The invention also provides a process for drawing off a liquid cryogenic mixture in a vessel provided with a circuit for cooling by expansion of a liquid escape, wherein the liquid is drawn off exclusively through the cooling circuit.

An embodiment of the invention will now be described with reference to the accompanying drawing in which.

Figure 1:
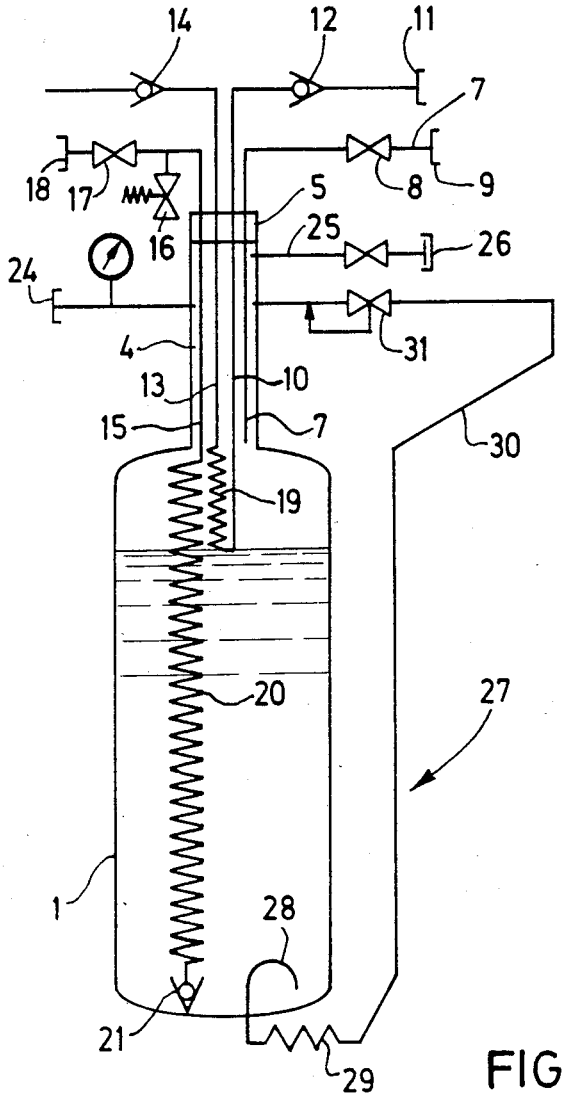
FIG. 1 is a diagrammatic longitudinal sectional view of a vessel according to the invention.
Figure 2:
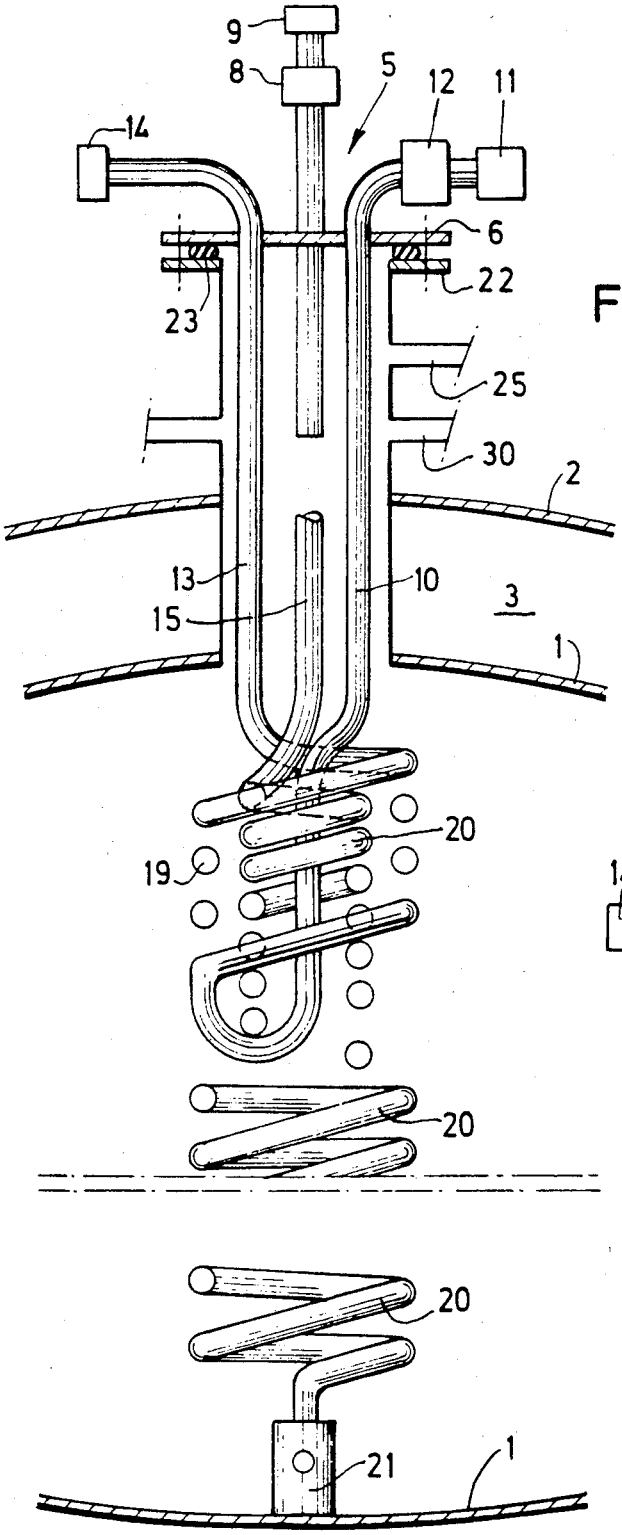
FIG. 2 is a view in more detail of the interior arrangement of the vessel.
Figure 3:
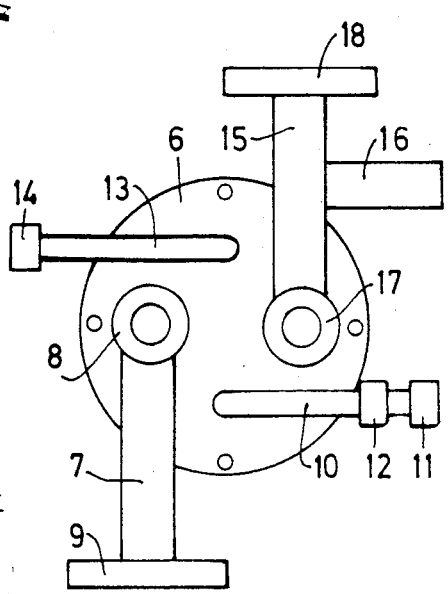
FIG. 3 is a plan view of the head of this vessel.

The illustrated vessel comprises an interior reservoir 1 having a capacity of for example 100 to 200 liters and an outer case 2 (not shown in FIG. 1) separated by a space 3 under a vacuum. The reservoir 1 has an upper neck 4 closed by a detachable head 5.

The head 5 is formed by a flange 6 through which vertically extend four conduits rigidly connected thereto, namely:

a filling conduit 7 from which the liquid falls freely, there being provided in the conduit a valve 8 and an inlet coupling 9 and the conduit being open at its lower end;

an inlet conduit 10 for a refrigerating agent provided with an inlet coupling 11 and a check-valve 12;

an outlet conduit 13 for this agent provided with a check-valve 14, and a conduit 15 for drawing off liquid and the escape of liquid including, outside the reservoir, a valve 16 for communication with the atmosphere, a valve 17 and an outlet coupling 18.

The conduit 7 terminates at an intermediate level in the neck 4 and the three other conduits 10, 13 and 16 extend downwardly roughly to the level of the connection of the neck 4 to the reservoir 1. In this region, the conduit 10 is connected to the inlet of a coiled heat exchange tube 19 whose outlet is connected to the inlet of the conduit 13. At the same level, the conduit 15 is connected to the upper end of a second coiled heat exchange tube 20 which extends to the bottom of the reservoir 1 where its lower end is provided with a calibrated valve 21. Throughout the height occupied by the tube 19, the tube 20 has a reduced diameter and is disposed inside the coils of the tube 19. Below the coiled tube 19, the coiled tube 20 has a larger diameter substantially equal to that of the coils of the tube 19 and slightly less than the inside diameter of the neck 4.

Thus the head 5, comprising the flange 6, the conduits 7, 10, 13 and 15 and the two coiled tubes 19 and 20, constitutes a detachable unit which may be fixed on the reservoir by passing the two coiled tubes through the neck and fixing the flange 6 by means of screws to a flange 22 provided at the entrance of the neck 4, with interposition of a sealing element 23.

In order to ensure that the two coiled tubes are suitably immobilised, the valve 21 bears against the bottom of the reservoir 1 and slightly compresses the coiled tube 20.

As shown in FIG. 1, the vessel further comprises:

a breaking disc 24 connected to the neck 4 by a pipe provided with a pressure gauge;

a purge pipe 25 connected to the neck 4 and provided with a valve and normally closed by a plug 26, and a pressure rise circuit 27 including a crook-shaped pipe 28 for drawing off liquid from the bottom of the reservoir 1, a vaporizer 29 and a conduit 30 connecting the latter to the neck 4 through a pressure regulator 31.

A cryogenic liquid mixture to be stored, for example a mixture of oxygen and nitrogen having 22% oxygen (i.e. substantially liquid air) is allowed to enter the reservoir by falling from the conduit 7 at the storage pressure (for example 10 to 20 bars). Before and during this filling, liquid nitrogen flows in the conduit 10 and the tube 19 and escapes in the gaseous state through the conduit 13 and ensures that the pressure during these filling operations, and in particular if the reservoir is initially hot, does not exceed the tolerated maximum value, with no need to put a part of the vapor phase or the liquid phase of the mixture in communication with the atmosphere.

During the storage, the inevitable entries of heat result in a certain vaporization of the liquid and an increase in pressure. When the latter exceeds the opening pressure of the valve 16 by a predetermined value corresponding to the calibration of the valve 21 (for example 2 bars), the latter opens and a small amount of liquid enters the coiled tube 20.

This escape of liquid is vaporized and then heated in the tube 20 by taking heat from the liquid and vapor phase above the latter, and the heated gas escapes through the valve 16. Consequently, the liquid is supercooled, the vapor is partly recondensed, and the pressure drops to a value at which the valve 21 and the valve 16 close again. In this way it is possible to keep, at the expense of a slight loss of liquid, the liquid in the reservoir with a substantially constant composition, since the vapor phase is never put in communication with the atmosphere.

Of the two phenomena explained hereinbefore, it is the recondensation of the vapor phase which constitutes the most efficient use of the cold state produced by the expansion of the liquid. Now, owing to the extension of the coiled tube 20 throughout the height of the reservoir, the heat exchange area contained in the vapor phase increases in proportion to the volume of this phase. The efficiency of the recondensation of the vapors is thus maximum.

When it is desired to draw off the liquid, the valve 17 is opened and this puts the conduit 15 in communication with the circuit of utilization (not shown) connected to the coupling 18. The circuit of utilization is assumed to be at a pressure lower than the storage pressure by an amount exceeding the pressure drop determined by the valve 21.

Consequently, this valve 21 opens and the whole of the liquid drawn off enters the tube 20, the valve 16 remaining closed. Consequently all of the drawn off liquid produces cold so that there is, on one hand, a supercooling of the liquid remaining in the reservoir and, on the other hand, a recondensation of the vapor phase above this liquid.

As soon as the pressure drops below a predetermined value, the pressure regulator 31 opens, liquid passes through the pipe 28 into the vaporizer 29, and the vapor thus produced is sent back through the conduit 30 to the neck of the reservoir until the set pressure is re-established. Owing to the rate at which the fluid flows in the circuit 27, the vapor re-injected into the neck 4 has the same composition as the liquid drawn off through the pipe 28.

Therefore, when liquid is drawn off, there is a simultaneous super-cooling of the liquid and a great stirring through the pressure raising circuit 27 which tends to maintain the vapor phase at the same composition as the liquid phase. These two phenomena oppose the distillation of the mixture and it is consequently possible to draw off substantially the whole of the liquid with no adverse variation in its composition.

It will also be seen that the fact of drawing off the liquid through the coiled tube 20 reduces to the maximum extent the number of conduits to be provided so that it is possible to pass all the required conduits through the neck of the reservoir, even if the latter is narrow. Consequently the invention can be easily adapted to existing small vessels of relatively low capacity.

By way of a modification, the valve 21 may be replaced by some other means capable of creating a pressure drop, for example by a capillary tube or a sintered element.

The vessel described hereinbefore has the circuit 10-19-13 since it was assumed that it was filled with the already-prepared liquid mixture. However, the mixture may also be achieved within the vessel itself in the following manner: the required amount of the most volatile liquid (for example liquid nitrogen) is supplied to the reservoir which cools the vessel and puts the nitrogen in equilibrium under atmospheric pressure at 77° K.; in an exterior condenser, which may be common to a group of vessels, the other constituent or constituents of the mixture (for example liquid oxygen) is or are supposed to the same temperature (for example in a coiled tube immersed in the liquid nitrogen) then it or they are introduced in the vessel. In this case, the circuit 10-19-13 is no longer necessary and consequently the detachable head 5 of the reservoir 1 has only two conduits extending through the flange 6, namely the conduits 7 and 15, and the structure of the reservoir is further simplified.

What is claimed is:

1. A vessel for a liquid cryogenic mixture comprising: a liquid-containing reservoir having a neck; a heat exchanger which is located in the reservoir and has an inlet and an outlet, said inlet being in communication with a lower part of the reservoir through an element creating a pressure drop; a pressure raising circuit comprising an inlet end in communication with said lower part of the reservoir, a vaporizer located outside the resevoir and an outlet end communicating with an upper part of the reservoir; and a conduit for drawing the liquid mixture off the reservoir, said conduit being connected to the outlet of the heat exchanger so that, in use, the whole of the liquid which is drawn off passes through said element and through said heat exchanger.

2. A vessel according to claim 1, wherein the heat exchanger extends substantially throughout the height of the reservoir.

3. A vessel according to claim 1, further comprising a filling conduit, a flange detachably fixed to an entrance of the neck of the reservoir, the filling conduit extending through the flange.

4. A vessel according to claim 3, further comprising an inlet conduit and an outlet conduit for a refrigerating auxiliary fluid, and an auxiliary heat exchanger interconnecting the inlet conduit and the outlet conduit, the inlet conduit and the outlet conduit extending through said flange.

5. A vessel according to claim 4, wherein each heat exchanger is in the form of a coiled tube.

6. A vessel according to claim 5, wherein the tubes are helically coiled tubes.

7. A vessel according to claim 4, wherein one of the heat exchangers is placed inside the other of the heat exchangers, the two heat exchangers forming an assembly having a transverse dimension which is less than the transverse dimension of the inside of the neck of the reservoir.

8. A vessel according to claim 1, wherein the heat exchanger is in the form of a coiled tube.

9. A vessel according to claim 8, wherein the tube is a helically coiled tube.

10. A vessel according to claim 9, wherein said element bears against a bottom of the reservoir so as to compress said tube.

11. A vessel according to claim 1, comprising a valve for communicating with the atmosphere and inserted in the conduit for drawing off the liquid mixture.

12. A vessel according to claim 1, comprising a breaking disc connected to an upper part of the reservoir.

13. A process for drawing off a liquid cryogenic mixture from a vessel comprising a liquid-containing reservoir having a neck; a heat exchanger which is located in the reservoir and has an inlet and an outlet, said inlet being in communication with a lower part of the reservoir through an element creating a pressure drop; and a pressure raising circuit comprising an inlet end in communication with said lower part of the reservoir, a vaporizer located outside the reservoir and an outlet end communicating with an upper part of the reservoir; the process comprising drawing off said liquid exclusively through said element and said heat exchanger and through the neck to a location outside the vessel.

14. A vessel for a liquid cryogenic mixture comprising: a reservoir having a neck and, in use, containing liquid having a free surface and an overlying vapor phase; a heat exchanger which is located inside the reservoir and extends substantially throughout the height of the reservoir and has an inlet and an outlet, said inlet being in communication with a lower part of the reservoir through an element creating a pressure drop; and a conduit connected to said outlet and extending through said reservoir neck, said conduit being provided with pressure-regulating vent means; the heat exchanger, in use, comprising a first part thereof in direct contact with the liquid and the remaining part thereof in direct contact with the overlying vapor phase, said first part extending upward to said free surface.

15. A vessel according to claim 14, wherein the heat exchanger is in the form of a coiled tube.

16. A vessel according to claim 15, wherein the tube is a helically coiled tube.

* * * * *